US011289858B2

(12) United States Patent
I

(10) Patent No.: US 11,289,858 B2
(45) Date of Patent: Mar. 29, 2022

(54) OVERHEATING DESTRUCTIVE MEMBER, CONDUCTING STRIP OVERHEATING POWER OFF STRUCTURE AND METHOD, PLUG HEAD AND PLUG SOCKET

(71) Applicant: Hsiang-Yun I, Tainan (TW)

(72) Inventor: Hsiang-Yun I, Tainan (TW)

( * ) Notice: Subject to any disclaimer, the term of this patent is extended or adjusted under 35 U.S.C. 154(b) by 0 days.

(21) Appl. No.: 17/046,799

(22) PCT Filed: Nov. 2, 2018

(86) PCT No.: PCT/CN2018/000377

§ 371 (c)(1),
(2) Date: Oct. 12, 2020

(87) PCT Pub. No.: WO2020/087190

PCT Pub. Date: May 7, 2020

(65) Prior Publication Data

US 2021/0083437 A1 Mar. 18, 2021

(51) Int. Cl.
*H01R 24/20* (2011.01)
*H01R 13/68* (2011.01)
(Continued)

(52) U.S. Cl.
CPC ..... *H01R 13/68* (2013.01); *H01R 24/20* (2013.01); *H01R 24/28* (2013.01); *H01R 25/003* (2013.01); *H01R 2103/00* (2013.01)

(58) Field of Classification Search
CPC ..... H01R 13/68; H01R 24/20
See application file for complete search history.

(56) References Cited

U.S. PATENT DOCUMENTS 6,741,159 B1 * 5/2004 Kuczynski ..... H01H 37/002 337/142
7,639,114 B2 * 12/2009 Yu ..... H01H 37/761 29/623

(Continued)

FOREIGN PATENT DOCUMENTS

CN 20140416502.2 A 3/2015
CN 20152022423.4 U 4/2015

(Continued)

*Primary Examiner* — Neil Abrams
(74) *Attorney, Agent, or Firm* — Muncy, Geissler, Olds & Lowe, P.C.

(57) ABSTRACT

A conducting strip overheating power off structure, comprises a first conducting strip, a second conducting strip, and an overheating destructive member. A first limiting strip and the second limiting strip of the overheating destructive member astride the first conducting strip and the second conducting strip. The first limiting strip or/and the second limiting strip is/are provided with a limiting portion, which enables the first conducting strip and the second conducting strip to be in contact with each other and form a closed circuit. The connecting portion connects the first limiting strip to the second limiting strip, and the supporting member is disposed between the first limiting strip and the second limiting strip. Accordingly, overheating of the supporting member causes the limiting portions to no longer capable to force the first conducting strip and the second conducting strip to be in contact with each other, thus forming an open circuit.

14 Claims, 8 Drawing Sheets

(51) Int. Cl.

| | |
|---|---|
| ***H01R 24/28*** | (2011.01) |
| ***H01R 25/00*** | (2006.01) |
| *H01R 103/00* | (2006.01) |

(56) References Cited

U.S. PATENT DOCUMENTS

| | | | | |
|---|---|---|---|---|
| 9,484,683 | B1 | 11/2016 | Wang | |
| 9,666,399 | B1 | 5/2017 | I | |
| 9,979,140 | B2 * | 5/2018 | I | H01R 13/696 |
| 10,283,294 | B2 * | 5/2019 | I | H01H 37/32 |
| 2005/0195547 | A1 * | 9/2005 | Huang | H01R 13/696 361/103 |

FOREIGN PATENT DOCUMENTS

| | | | |
|---|---|---|---|
| CN | 20158001901.5 | A | 4/2015 |
| CN | 201620946027.4 | U | 8/2016 |

* cited by examiner

OVERHEATING DESTRUCTIVE MEMBER, CONDUCTING STRIP OVERHEATING POWER OFF STRUCTURE AND METHOD, PLUG HEAD AND PLUG SOCKET

BACKGROUND OF THE INVENTION

(a) Field of the Invention

The present invention relates to an overheating destructive member, conducting strip overheating power off structure and method, plug head and plug socket, and more particularly to an overheating destructive member having initial dimensions in a normal state that forces a first conducting strip and a second conducting strip to contact with each other to form a closed circuit. When the overheating destructive member is exposed to an overheating temperature exceeding the operating temperature, the dimensions of the overheating destructive member form overheating dimensions, which cause the first conducting strip and the second conducting strip to lose the force that causes contact therebetween and mutually separate to form an open circuit.

(b) Description of the Prior Art

A circuit is usually installed with a fuse or a circuit breaker to prevent the circuit from conditions such as current overloading, short circuiting, or overheating. When a circuit overheats or sustains a current overload, the fuse is affected by the high temperature and burns out or a metal spring piece of the circuit breaker trips, thereby causing the circuit to form an open circuit which cuts off the power supply, thus safeguarding the safety of using electricity.

The applicant of the present invention has previously proposed a solution directed at this problem in Taiwan patent No. CN104426005 that discloses a "Plug socket with overheating destructive limiting member". Other prior art include U.S. Pat. No. 9,666,399 that discloses a "Metal and plastic safety clip to protect against overheating in a plug or socket", and U.S. Pat. No. 9,484,683 that discloses a "Conductive terminal". The configurations of the prior art generally comprise two conductive members and a limiting member, wherein the limiting member is used to hold the aforementioned two conductive members in contact with each other to form a closed circuit. The limiting member deforms and is destroyed when a heat deformation temperature is reached, which causes the aforementioned two conductive members to mutually separate to form an open circuit. However, in each of the aforementioned patents, the limiting member splits and flies apart after destruction thereof.

SUMMARY OF THE INVENTION

The present invention relates to an overheating destructive member, which in a normal state presses together a first conducting strip and a second conducting strip. The overheating destructive member comprises: a first limiting strip, a second limiting strip, a connecting portion, and a supporting member. The first limiting strip is provided with a first free end, which is configured with a first limiting portion, and the second limiting strip is provided with a second free end, which is configured with a second limiting portion. In a normal state, the distance between the first limiting strip and the second limiting strip is defined as an initial clearance. In a normal state, the maximum distance between the first limiting portion and the second limiting portion is defined as a limiting clearance, which is greater than the initial clearance. The connecting portion connects the first limiting strip to the second limiting strip, and the supporting member is disposed between the first limiting strip and the second limiting strip. In a normal state, the supporting member limits contraction between the first limiting strip and the second limiting strip, but is destructed when the temperature thereof reaches an overheating temperature that exceeds the operating temperature. The first limiting strip and the second limiting strip are acted on by an acting force forcing contraction therebetween, which causes the limiting clearance to be smaller than the initial clearance.

The present invention further provides a conducting strip overheating power off structure, comprising: the first conducting strip, the second conducting strip, and the overheating destructive member, wherein the first conducting strip is provided with a first notch, the second conducting strip is provided with an acting force at a distance from the first conducting strip, and the second conducting strip is provided with a second notch corresponding to the first notch. The first notch and the second notch form an indentation when superimposed, which is provided with an indentation width. The overheating destructive member comprises the first limiting strip, the second limiting strip, the connecting portion, and the supporting member. The first limiting strip is provided with the first free end, which is configured with the first limiting portion, and the first limiting strip astrides the indentation. The second limiting strip is provided with the second free end, which is configured with the second limiting portion, and the second limiting strip astrides the indentation. In a normal state, the distance between the first limiting strip and the second limiting strip is defined as an initial clearance, which is less than or equal to the indentation width. In a normal state, the maximum distance between the first limiting portion and the second limiting portion is defined as a limiting clearance, which is greater than the indentation width. The connecting portion connects the first limiting strip to the second limiting strip. The supporting member is disposed between the first limiting strip and the second limiting strip, and in a normal state limits contraction between the first limiting strip and the second limiting strip. In a normal state, the first limiting portion or/and the second limiting portion force the second conducting strip to contact the first conducting strip. Overheating of the supporting member causes destruction thereof, at which time the acting force forces the first limiting strip to move closer to the second limiting strip, whereupon the limiting clearance is less than or equal to the indentation width and causes the second conducting strip to be at a distance from the first conducting strip.

The present invention further provides a conducting strip overheating power off structure, comprising: a first conducting strip, a second conducting strip, and an overheating destructive member, wherein the first conducting strip is provided with a first notch, and the second conducting strip is provided with a second notch corresponding to the first notch. The first notch and the second notch form an indentation when superimposed. The overheating destructive member comprises the first limiting strip, the second limiting strip, a connecting portion, and a supporting member, wherein both the first limiting strip and the second limiting strip astride the indentation. The first limiting strip or/and the second limiting strip is/are provided with a limiting portion, and the connecting portion connects the first limiting strip to the second limiting strip. The supporting member is disposed between the first limiting strip and the second limiting strip, which in a normal state limits contraction between the first limiting strip and the second limiting strip. The limiting portions force the second conducting strip to contact the first conducting strip to form a closed circuit, which causes the second conducting strip to store an acting force. Overheating of the supporting member causes destruction thereof, at which time the acting force forces the first limiting strip and the second limiting strip to move closer together that causes movement of the limiting portions in the direction of the indentation and thus insufficient to force the first conducting strip and the second conducting strip to be in contact with each other. Accordingly, the acting force is used to separate the first conducting strip and the second conducting strip to form a broken circuit.

The present invention further provides a plug socket provided with conducting strip overheating power off structures, each of which comprises: a live wire slot, a neutral wire slot, a first conducting strip, a second conducting strip, an overheating destructive member, and a body case. The first conducting strip connects to the live wire slot, wherein the first conducting strip is provided with a first notch. The second conducting strip is provided with an acting force at a distance from the first conducting strip, and is further provided with a second notch corresponding to the first notch. The first notch and the second notch together form an indentation having an indentation width when superimposed. The overheating destructive member comprises a first limiting strip, a second limiting strip, a connecting portion, and a supporting member. The first limiting strip is provided with a first free end, which is configured with a first limiting portion, and the first limiting strip astrides the indentation. The second limiting strip is provided with a second free end, which is configured with a second limiting portion, and the second limiting strip astrides the indentation. In a normal state, the distance between the first limiting strip and the second limiting strip is defined as an initial clearance, which is less than or equal to the indentation width. In a normal state, the maximum distance between the first limiting portion and the second limiting portion is defined as a limiting clearance, which is greater than the indentation width. The connecting portion connects the first limiting strip to the second limiting strip, and the supporting member is disposed between the first limiting strip and the second limiting strip. In a normal state, the supporting member limits contraction between the first limiting strip and the second limiting strip. The body case holds the live wire slots, the neutral wire slots, the first conducting strips, the second conducting strips, the first limiting strips, the second limiting strips, the connecting portions, and the supporting member. The body case is configured with live wire sockets and neutral wire sockets, wherein the position of the live wire sockets correspond to the respective live wire slots, and the position of the neutral wire sockets correspond to the respective neutral wire slots. In a normal state, the first limiting portion or/and the second limiting portion force the second conducting strip to contact the first conducting strip. Overheating of the supporting member causes destruction thereof, at which time the acting force forces the first limiting strip and the second limiting strip to move closer together, whereupon the limiting clearance is less than or equal to the indentation width, which causes the second conducting strip to be at a distance from the first conducting strip.

The present invention further provides a plug head provided with a conducting strip overheating power off structure, comprising: a live wire pin, a neutral wire pin, a first conducting strip, a second conducting strip, an overheating destructive member, and a main body. The first conducting strip connects to the live wire pin, wherein the first conducting strip is provided with a first notch. The second conducting strip is provided with an acting force at a distance from the first conducting strip, and the second conducting strip is provided with a second notch corresponding to the first notch. The first notch and the second notch form an indentation having an indentation width when superimposed. The overheating destructive member comprises a first limiting strip, a second limiting strip, a connecting portion, and a supporting member. The first limiting strip is provided with a first free end, which is configured with a first limiting portion, and the first limiting strip astrides the indentation. The second limiting strip is provided with a second free end, which is configured with a second limiting portion, and the second limiting strip astrides the indentation. In a normal state, the distance between the first limiting strip and the second limiting strip is defined as an initial clearance, which is less than or equal to the indentation width. In a normal state, the maximum distance between the first limiting portion and the second limiting portion is defined as a limiting clearance, which is greater than the indentation width. The connecting portion connects the first limiting strip to the second limiting strip, and the supporting member is disposed between the first limiting strip and the second limiting strip. In a normal state the supporting member limits contraction between the first limiting strip and the second limiting strip. The main body holds the live wire pin, the neutral wire pin, the first conducting strip, the second conducting strip, the first limiting strip, the second limiting strip, the connecting portion, and the supporting member. The live wire pin and the neutral wire pin both protrude out from the main body. The first limiting portion or/and the second limiting portion force the second conducting strip to contact the first conducting strip. Overheating of the supporting member causes destruction thereof, at which time the acting force forces the first limiting strip and the second limiting strip to move closer together, whereupon the limiting clearance is less than or equal to the indentation width, which causes the second conducting strip to be at a distance from the first conducting strip.

Furthermore, the first limiting strip, the second limiting strip, and the connecting portion are formed as a single body, each of which are made from conductive material.

Further, the first limiting portion or/and the second limiting portion are arc curved surfaces.

Further, the first limiting strip, the second limiting strip, and the connecting portion together define a holding space. The shape of the supporting member corresponds to the holding space.

Further, the maximum clearance of the connecting portion in the direction of the initial clearance is defined as a positioning clearance, which is greater than the indentation width.

The present invention further provides a conducting strip overheating power-off method, comprising the following steps:

Configuring the first conducting strip and the second conducting strip, wherein the second conducting strip is provided with an acting force at a distance from the first conducting strip. The direction of the acting force is defined as an X direction, and the extension direction of the first conducting strip is defined as a Y direction;

Configuring the overheating destructive member, which has initial dimensions in the Y direction in a normal state. When the overheating destructive member is exposed to an overheating temperature exceeding the operating temperature, the dimensions thereof change in the Y direction and form overheating dimensions, at which time the overheating dimensions are unable to force the second conducting strip to contact the first conducting strip. In a normal state, the initial dimensions of the overheating destructive member are used to force the second conducting strip to contact the first conducting strip in the X direction, forming a live wire closed circuit or a neutral wire closed circuit that enables the operating temperature of the first conducting strip or/and the second conducting strip to be transferred to the overheating destructive member. When the overheating destructive member is exposed to an overheating temperature exceeding the operating temperature, the acting force forces the dimensions of the overheating destructive member to form overheating dimensions in the Y direction, thereby causing the second conducting strip to separate from the first conducting strip that breaks the live wire closed circuit or the neutral wire closed circuit.

Further, in a normal state the overheating destructive member uses the supporting member to maintain the initial dimensions, and applies the conditions of over temperature destructing the supporting member and the supporting member having the function to form overheating dimensions.

Further, after the second conducting strip is forced to separate from the first conducting strip, the first conducting strip supports the overheating destructive member, thereby preventing the overheating destructive member from falling off.

Based on the above-described technological characteristics:

1. The first limiting strip, the second limiting strip, and the supporting member are resilient to phenomena such as splitting and flying apart, and uses the dimensional design of the connecting portion to enable the first conducting strip to still able to support the overheating destructive member after the second conducting strip separates from the first conducting strip, thereby preventing the overheating destructive member from falling apart, that would otherwise affect circuit structural safety.

2. The supporting member is disposed between the first limiting strip and the second limiting strip, thereby preventing damage thereto.

3. When the temperature of a circuit reaches an over temperature, the first limiting strip and the second limiting strip compress the supporting member, causing steady straining and ultimate destruction thereof, thereby achieving more stability and reliability in use.

4. The first limiting strip, the second limiting strip, and the connecting portion can be formed as a single body from conductive material that fulfills the Product Safety Certification requirements of a portion of world regions.

5. The first limiting portion or/and the second limiting portion are arc curved surfaces, which prevent the second conducting strip from sticking that would otherwise disable positional movement thereof.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Based on the above-described technological characteristics, the main effects of an overheating destructive member, conducting strips, an overheating power off structure and method, a plug head, and a plug socket of the present invention are clearly presented in the following embodiments.

The so called "normal state" of the present invention indicates a normal current conducting state. For example, when the aforementioned conducting strip overheating power off structure is applied in a plug socket or a plug head, the so-called "normal state" does not include states such as an electric power overload of the plug socket or the plug head in use, poor contact between the plug socket and the plug head, the plug socket or the plug heading allowing electric current to flow through an undersized sectional area, foreign substances deposited between the contact surfaces of the plug socket and the plug head, and other improper uses of the plug socket or the plug head.

Figure 1:
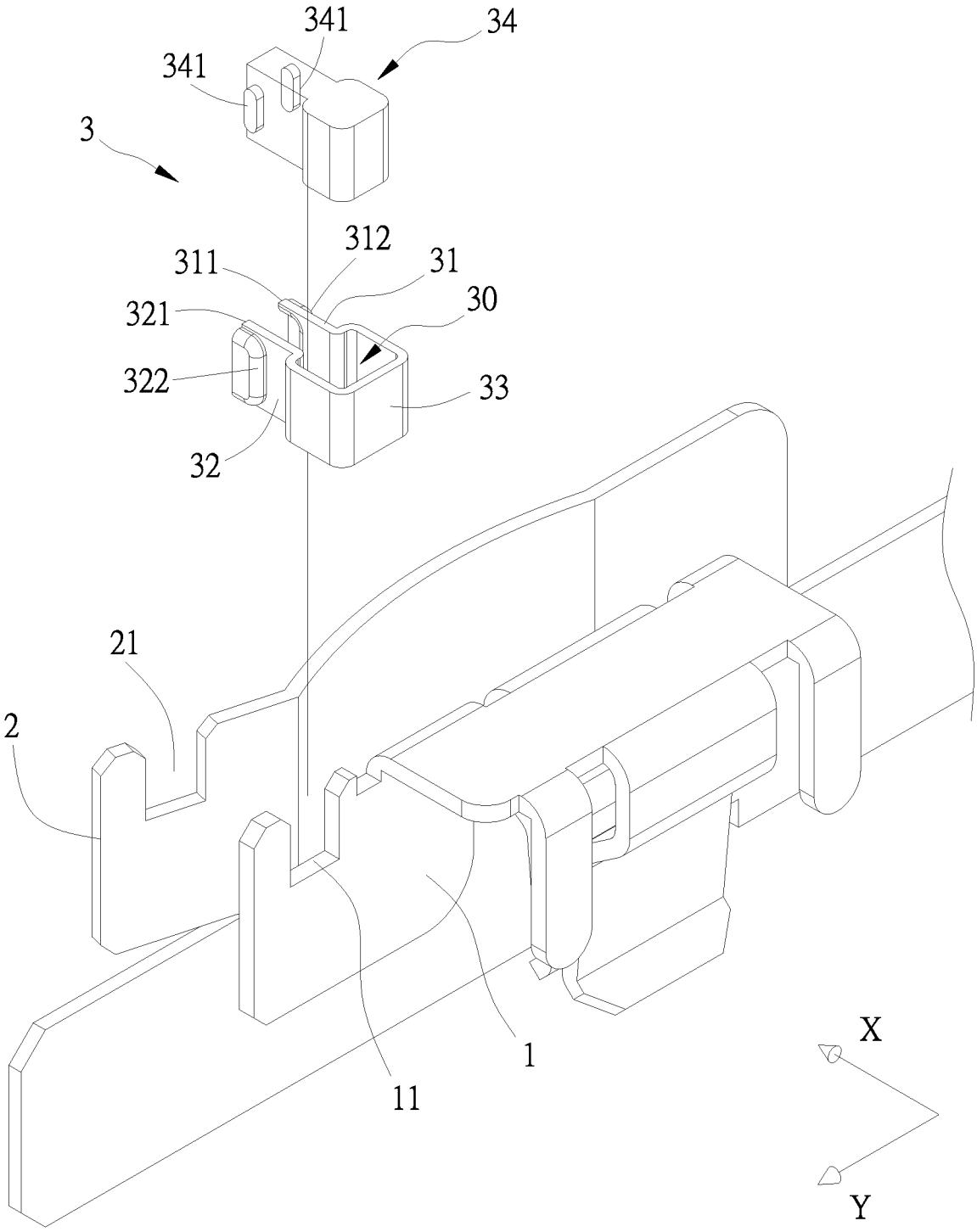
FIG. 1 is an exploded three-dimensional schematic view of a first conducting strip, a second conducting strip, and an overheating destructive member of a first embodiment of the present invention.
Figure 2:
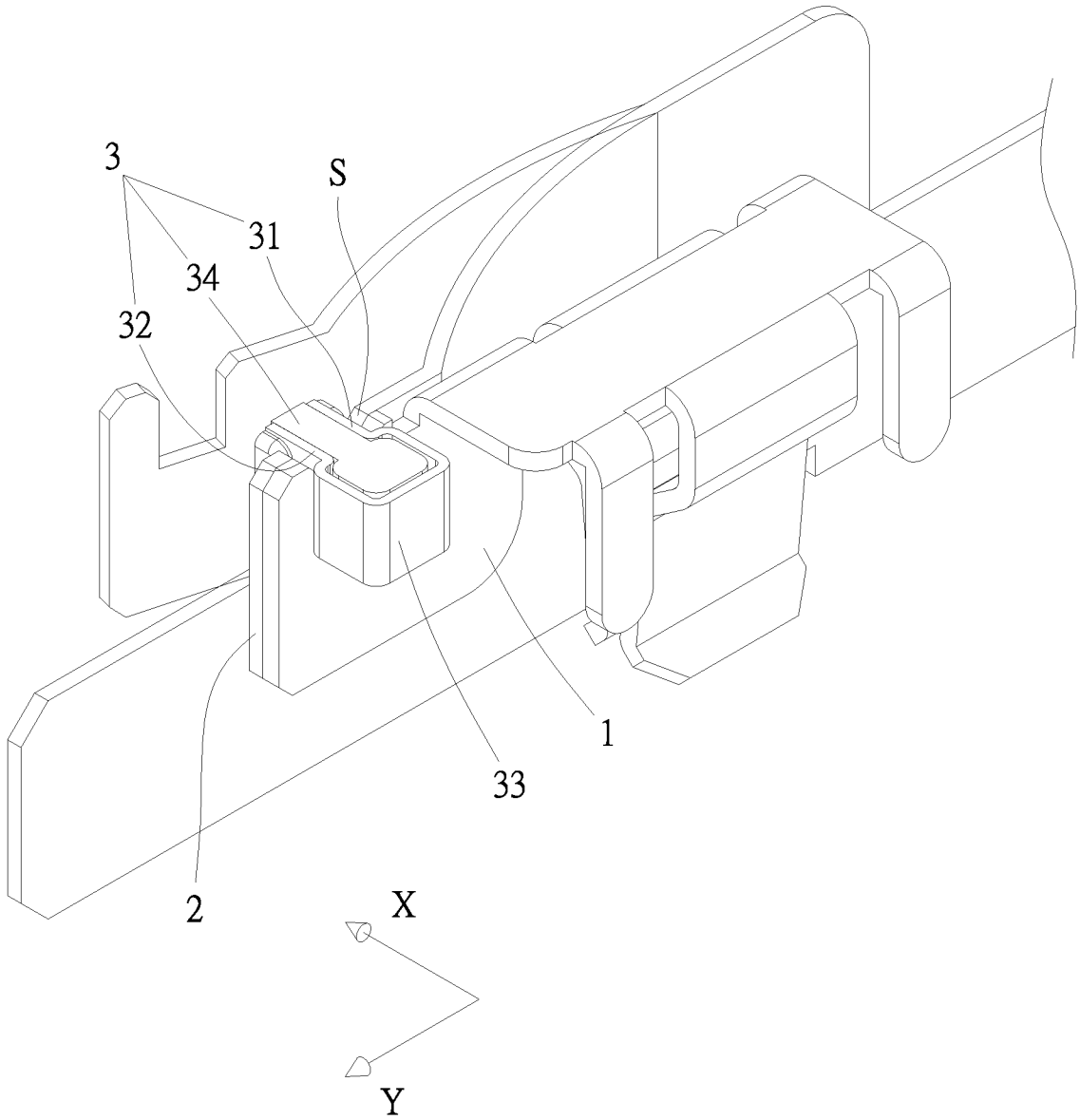
FIG. 2 is an assembled three-dimensional schematic view of the first conducting strip, the second conducting strip, and the overheating destructive member of the first embodiment of the present invention.

Referring first to FIG. 1 and FIG. 2, which show a first embodiment of a conducting strip overheating power off structure of the present invention, comprising: a first conducting strip (1), a second conducting strip (2), and an overheating destructive member (3), wherein:

The first conducting strip (1) is provided with a first notch (11), and the second conducting strip (2) is provided with a second notch (21) corresponding to the first notch (11). The second conducting strip (2) is provided with an acting force at a distance from the first conducting strip (1), for example, the second conducting strip (2) is preset with an open circuit position corresponding to the first conducting strip (1). Therefore, the first notch (11) and the second notch (21) together form an indentation (S) when superimposed and store up an elastic force. However, an external elastic member can also provide the elastic force, but is not limited by such in practical application. In addition, the direction of the acting force can be defined as an X direction, and the extension direction of the first conducting strip (1) can be defined as a Y direction.

The overheating destructive member (3) comprises a first limiting strip (31), a second limiting strip (32), a connecting portion (33), and a supporting member (34).

The first limiting strip (31) and the second limiting strip (32) astride and are disposed in the indentation (S). The first limiting strip (31) or/and the second limiting strip (32) is/are provided with a limiting portion, and in the present embodiment, the first limiting strip (31) is provided with a first free end (311), which is configured with a first limiting portion (312); the second limiting strip (32) is provided with a second free end (321), which is configured with a second limiting portion (322). The first limiting portion (312) or/and the second limiting portion (322) is/are cambered surface(s). The connecting portion (33) connects the first limiting strip (31) to the second limiting strip (32). In the present embodiment, the first limiting strip (31), the second limiting strip (32), and the connecting portion (33) can be structured to form a single body from conductive materials (such as metal).

The supporting member (34) is disposed between the first limiting strip (31) and the second limiting strip (32), which, in a normal state, enables restricting contraction between the first limiting strip (31) and the second limiting strip (32), causing the first limiting portion (312) or/and the second limiting portion (322) to force the second conducting strip (2) to contact the first conducting strip (1). More specifically. the first limiting strip (31), the second limiting strip (32), and the connecting portion (33) together define a holding space (30), wherein the shape of the supporting member (34) in the present embodiment corresponds to the holding space (30) to enable fitting therein. Based on this, the supporting member (34) is provided with a pair of clasping portions (341), which are used to respectively clasp the first limiting strip (31) and the second limiting strip (32), thereby better fixing the supporting member (34) and preventing loosening thereof. Accordingly, a concave-convex or convex-concave matching configuration can be formed between the clasping portions (341), the first limiting strip (31), and the second limiting strip (32), but is not limited by such in practical application. In addition, the shape of the above-described supporting member (34) does not necessarily have to correspond to the holding space (30), that is, whether or not the shape of the supporting member (34) completely fills the holding space (3) is not the key factor; the expectant effect is achieved as long as the supporting member (34) positioned in the region between the first limiting strip (31) and second limiting strip (32) is able to limit contraction between the first limiting strip (31) and the second limiting strip (32). Therefore, the form of the supporting member (34) can be a block body, cylindrical body, an oval-shaped cylindrical body, or an irregular shaped block body.

The supporting member (34) is destructed under a fail temperature condition. Insulating material is used for the supporting member (34), such as plastic (including thermoset plastic or thermoplastic plastic), or non-insulating material can be used, such as metal or an alloy, with a low-melting alloy being preferred. Hence, the destruction method of the supporting member (34) includes any one of the following circumstances: softening, melting, liquefying, deforming, splitting, thermal decomposition, or charring.

Figure 3:
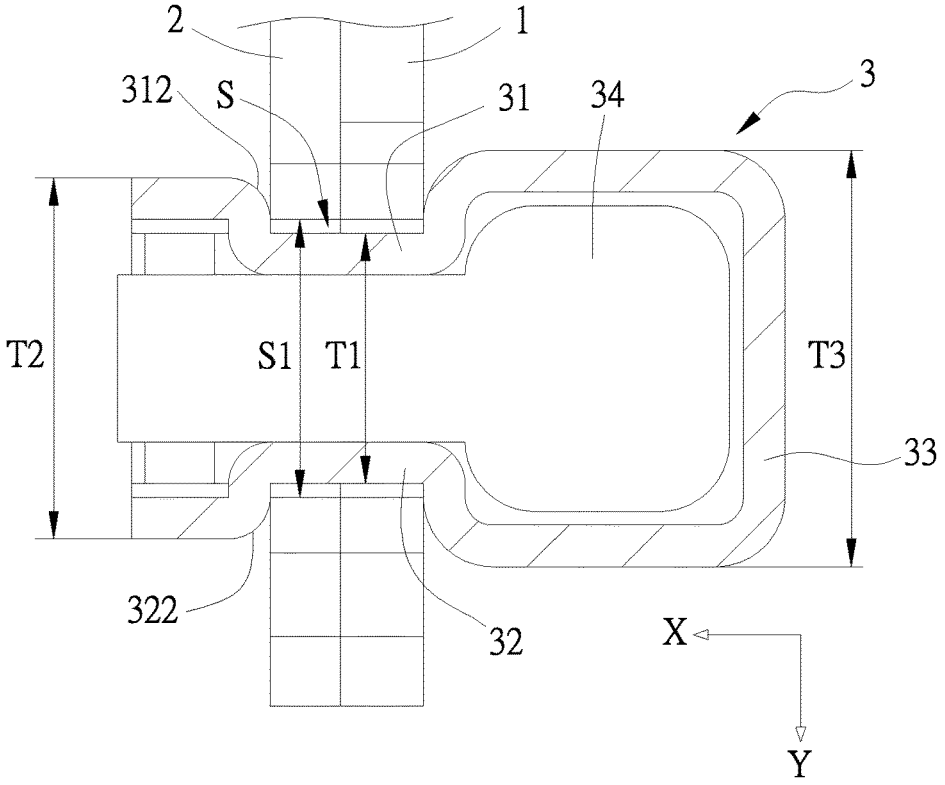
FIG. 3 is an overhead schematic view of the overheating destructive member causing the first conducting strip and the second conducting strip to come in contact with each other according to the first embodiment of the present invention.

Referring further to FIG. 3, which shows the indentation (S) having an indentation width (S1). In a normal state, the distance between the first limiting strip (31) and the second limiting strip (32) is defined as an initial clearance (T1). which is less than or equal to the indentation width (S1). In a normal state, the maximum distance between the first limiting portion (312) and the second limiting portion (322) is defined as a limiting clearance (T2), which is greater than the indentation width (S1). The maximum clearance of the connecting portion (33) in the direction of the initial clearance (T1) is defined as a positioning clearance (T3), which is greater than the indentation width (S1).

Figure 4:
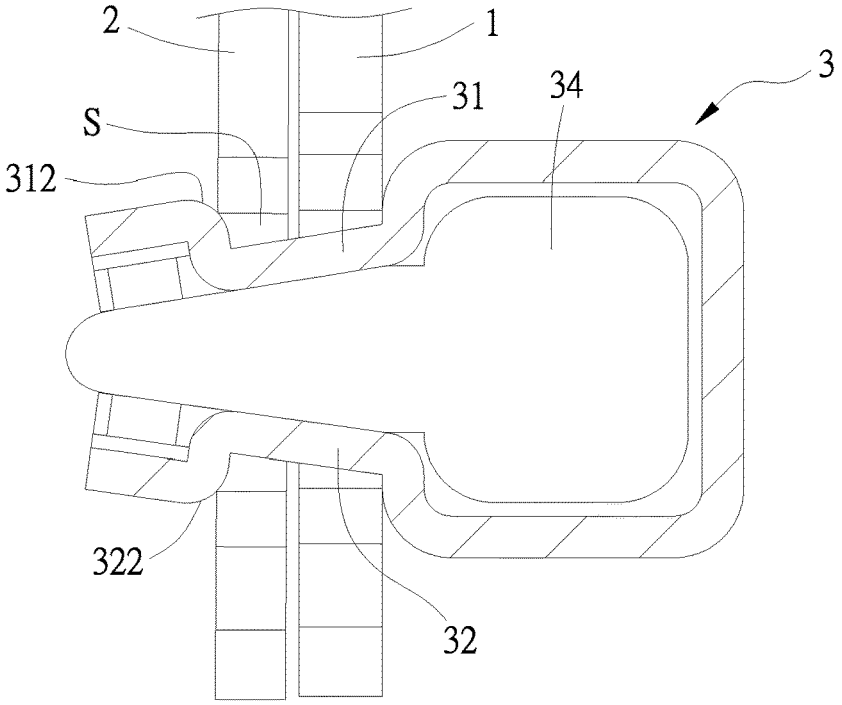
FIG. 4 is an overhead schematic view showing a protected circuit that has overheated causing a first limiting strip and a second limiting strip of the overheating destructive member to move closer together according to the first embodiment of the present invention.
Figure 5:
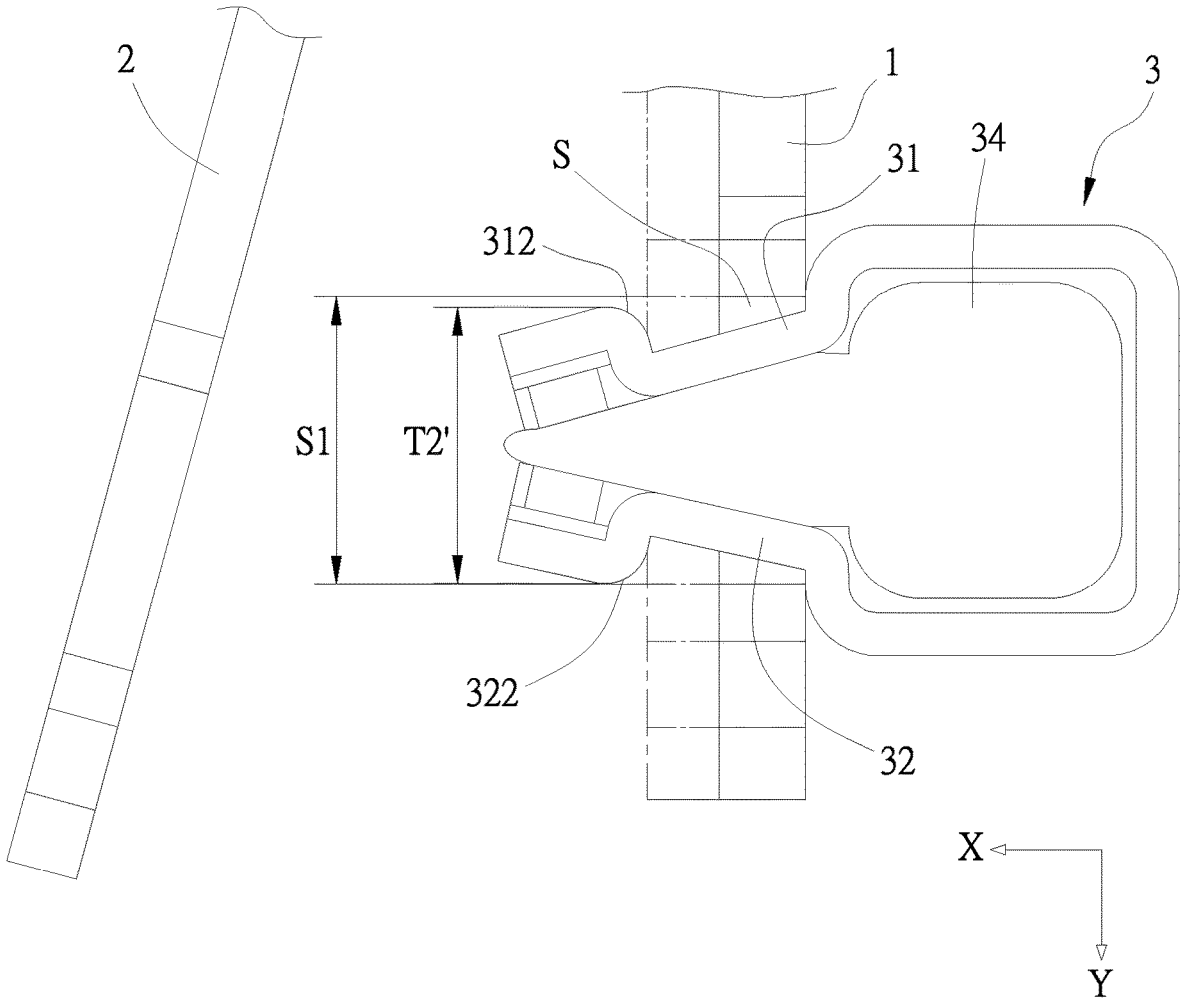
FIG. 5 is an overhead schematic view showing a protected circuit that has overheated causing the first conducting strip and the second conducting strip to correspondingly open to form an open circuit according to the first embodiment of the present invention.

Referring to FIG. 4 and FIG. 5, an abnormal condition in the electric current or voltage in a circuit requiring protection causes heating up of the first conducting strip (1) and the second conducting strip (2), whereupon the heat from the first conducting strip (1) and the second conducting strip (2) is conducted to the supporting member (34). The supporting member (34) is destructed when the temperature of the supporting member (34) reaches an overheating temperature that exceeds the operating temperature. For example, the supporting member (34) is heat destructed (including phenomena such as softening, melting, liquefying, deforming, splitting, thermal decomposition, or charring) when the operating temperature rises to a temperature of approximately 130° C. or 140° C. At which time the acting force of the second conducting strip (2) forces contraction between the first limiting strip (31) and the second limiting strip (32), causing displacement of the first limiting portion (312) or/and the second limiting portion (322) along the indentation (S), which results in a limiting clearance (T2') to be greater than or equal to the indentation width (S1), and thus insufficient to force the first conducting strip (1) and the second conducting strip (2) to be in contact with each other. In such a way, the acting force is used to separate the first conducting strip (1) and the second conducting strip (2) to form a broken circuit.

Referring to FIG. 3 and FIG. 5, in other words. in a normal state, the overheating destructive member (3) has initial dimensions in the Y direction; moreover, the supporting member (34) is used to maintain these initial dimensions. The initial dimensions of the overheating destructive member (3) are used to force the second conducting strip (2) to contact the first conducting strip (1) in the X direction to form a closed circuit. (such as a live wire closed circuit or neutral wire closed circuit). At which time, heat from the operating temperature of the first conducting strip (1) or/and the second conducting strip (2) is transferred to the overheating destructive member (3). When the overheating destructive member (3) is exposed to an overheating temperature exceeding the operating temperature, the acting force changes the dimensions of the overheating destructive member (3) in the Y direction to form overheating dimensions. For example, destruction of the supporting member (34) under the over temperature condition to form overheating dimensions thereof are used to disable the acting force from enabling the second conducting strip (2) to contact the first conducting strip (1), which causes the second conducting strip (2) to separate from the first conducting strip (1), thereby forming a broken circuit (such as breaking a live wire closed circuit or a neutral wire closed circuit). It is preferred that after the second conducting strip (2) separates from the first conducting strip (1), then the first conducting strip (1) is able to support the overheating destructive member (3), thereby preventing the overheating destructive member (3) from arbitrarily falling apart.

Figure 6:
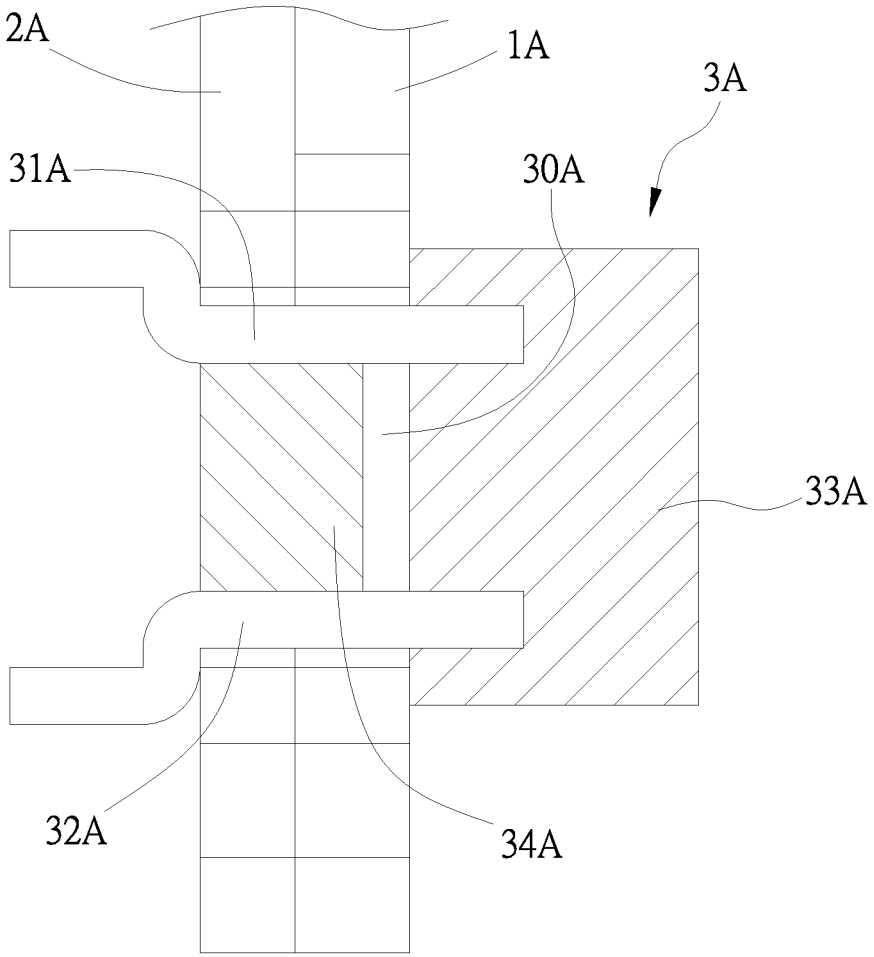
FIG. 6 is a planar schematic view of a first limiting strip, a second limiting strip, and a connecting portion forming a non-integral body of a second embodiment of the present invention.

Referring to FIG. 6, which shows a second embodiment of the present invention, wherein the form of an overheating destructive member (3A) is practically the same as the overheating destructive member (3) of the first embodiment and comprises a first limiting strip (31A), a second limiting strip (32A), a connecting portion (33A), and a supporting member (34A). The first limiting strip (31A), the second limiting strip (32A), and the connecting portion (33A) define a holding space (30A). The differences with the first embodiment lie in the first limiting strip (31A), the second limiting strip (32A), and the connecting portion (33A) being formed as a single body; and the form of the supporting member (34A) does not correspond to the holding space (30A), only being used to support the first limiting strip (31A) and the second limiting strip (32A). The overheating destructive member (3A) only needs to enable a first conducting strip (1A) and a second conducting strip (2A) to contact each other, Accordingly, destruction of the supporting member (34A) under an over temperature condition changes the dimensions thereof, thereby enabling achieving the object of overheating power-off.

Figure 7:
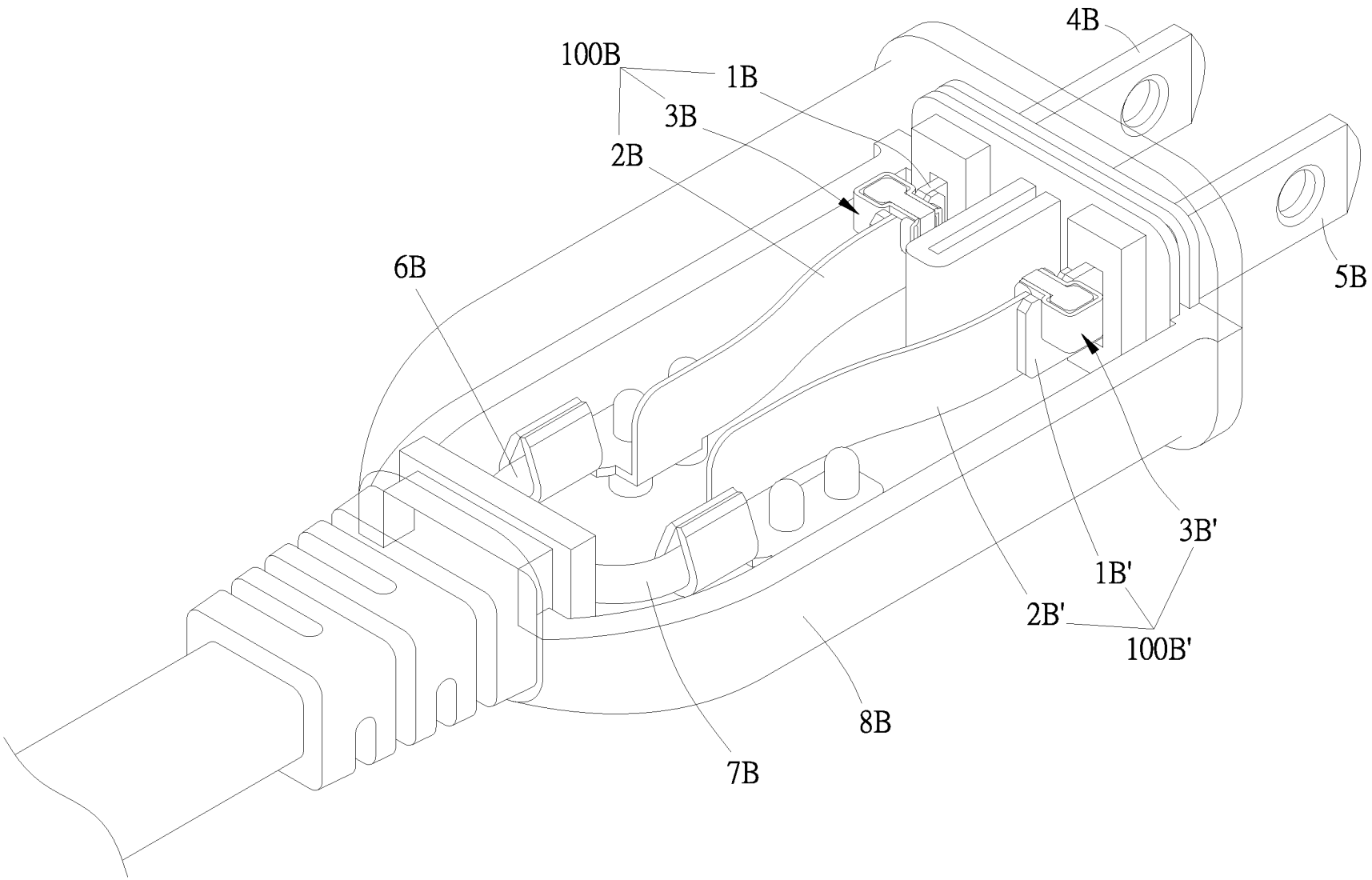
FIG. 7 is a schematic view of the present invention used in a plug head.

Referring to FIG. 7, which shows a third embodiment of the present invention, which uses conducting strip overheating power off structures as overheating protection in a plug head. The plug head in the present embodiment comprises: a live wire pin (4B), a neutral wire pin (5B), two conducting strip overheating power off structures (100B), (100B'), a live wire (6B), a neutral wire (7B), and a main body (8B). The form of each of the aforementioned conducting strip overheating power off structures (100B), (100B') is the same as that above-described in the first embodiment, wherein a first conducting strip (1B) and a second conducting strip (2B) of the conducting strip overheating power off structure (100B) are respectively connected to the live wire pin (4B) and the live wire (6B), and in a normal state uses an overheating destructive member (3B) to force a first conducting strip (1B) and a second conducting strip (2B) to contact each other. A first conducting strip (1B') and a second conducting strip (2B') of the conducting strip overheating power off structure (100B') are respectively connected to the neutral wire pin (5B) and the neutral wire (7B), and in a normal state uses another overheating destructive member (3B') to force the first conducting strip (1B') and the second conducting strip (2B') to contact each other. The main body (8B) holds the live wire pin (4B), the neutral wire pin (5B), and the above-described conducting strip overheating power off structures (100B), (100B'), wherein the live wire pin (4B) and the neutral wire pin (5B) both protrude out from the main body (8B). Accordingly, when an abnormal condition occurs in an external electric equipment connected to the live wire pin (4B) or the neutral wire pin (5B), for example, the external electric equipment is a plug socket, phenomena such as oxides or dust present between the live wire pin (4B) or the neutral wire pin (5B) and the plug socket, the live wire pin (4B) or the neutral wire pin (5B) is not completely inserted into the plug socket, or the live wire pin (4B) or the neutral wire pin (5B) is deformed will produce relatively large amounts of heat energy in the electrical conducting portions of the plug socket. At which time the heat energy is transferred to the overheating destructive member (100B) or the other overheating destructive member (100B'), which are destructed forthwith, thereby forming a broken circuit between the live wire pin (4B) and the live wire (6B) or/and between the neutral wire pin (5B) and the neutral wire (7B), thus achieving the object of overheating power-off.

Figure 8:
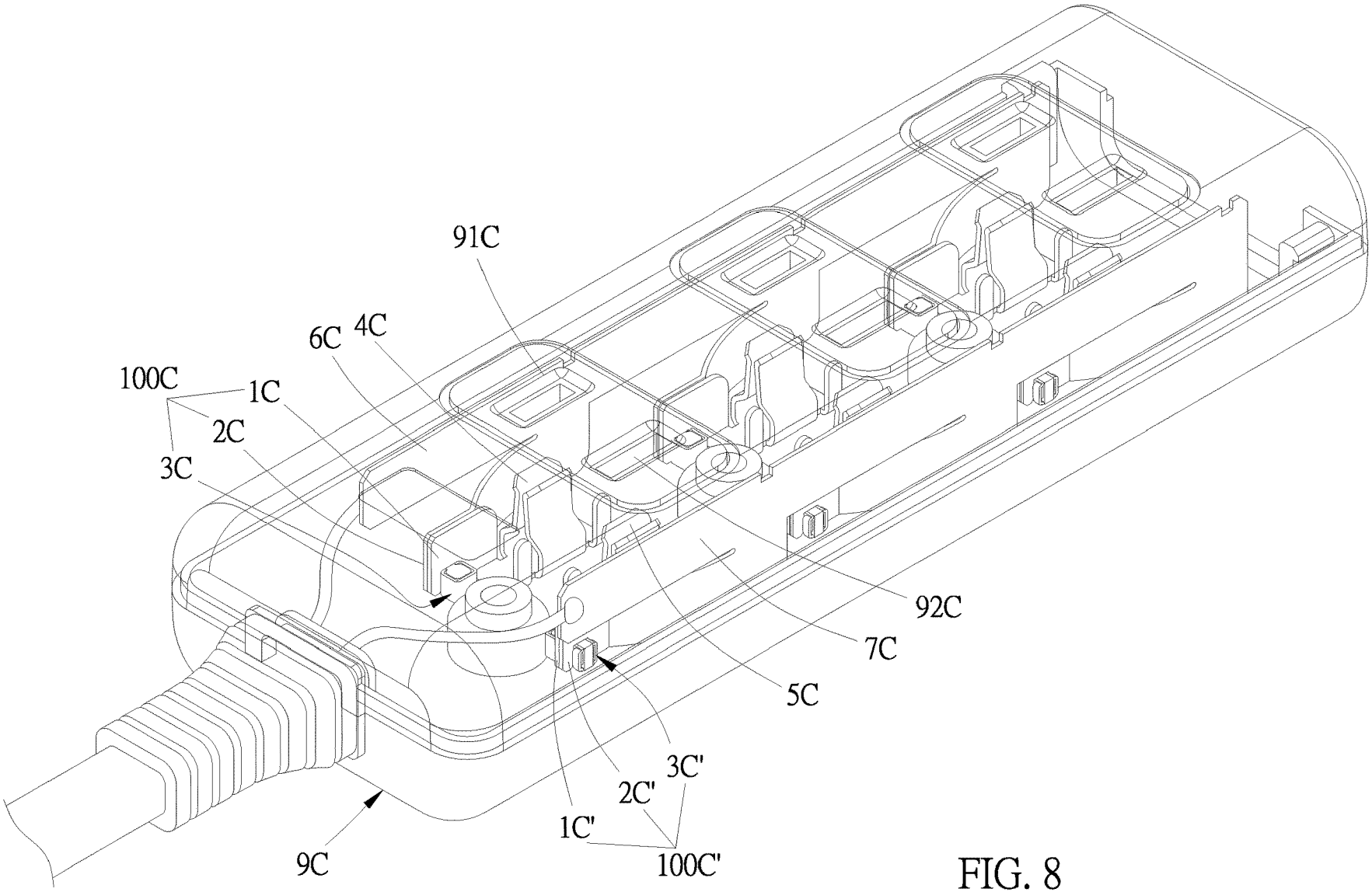
FIG. 8 is a schematic view 1 of the present invention used in a plug socket.
Figure 9:
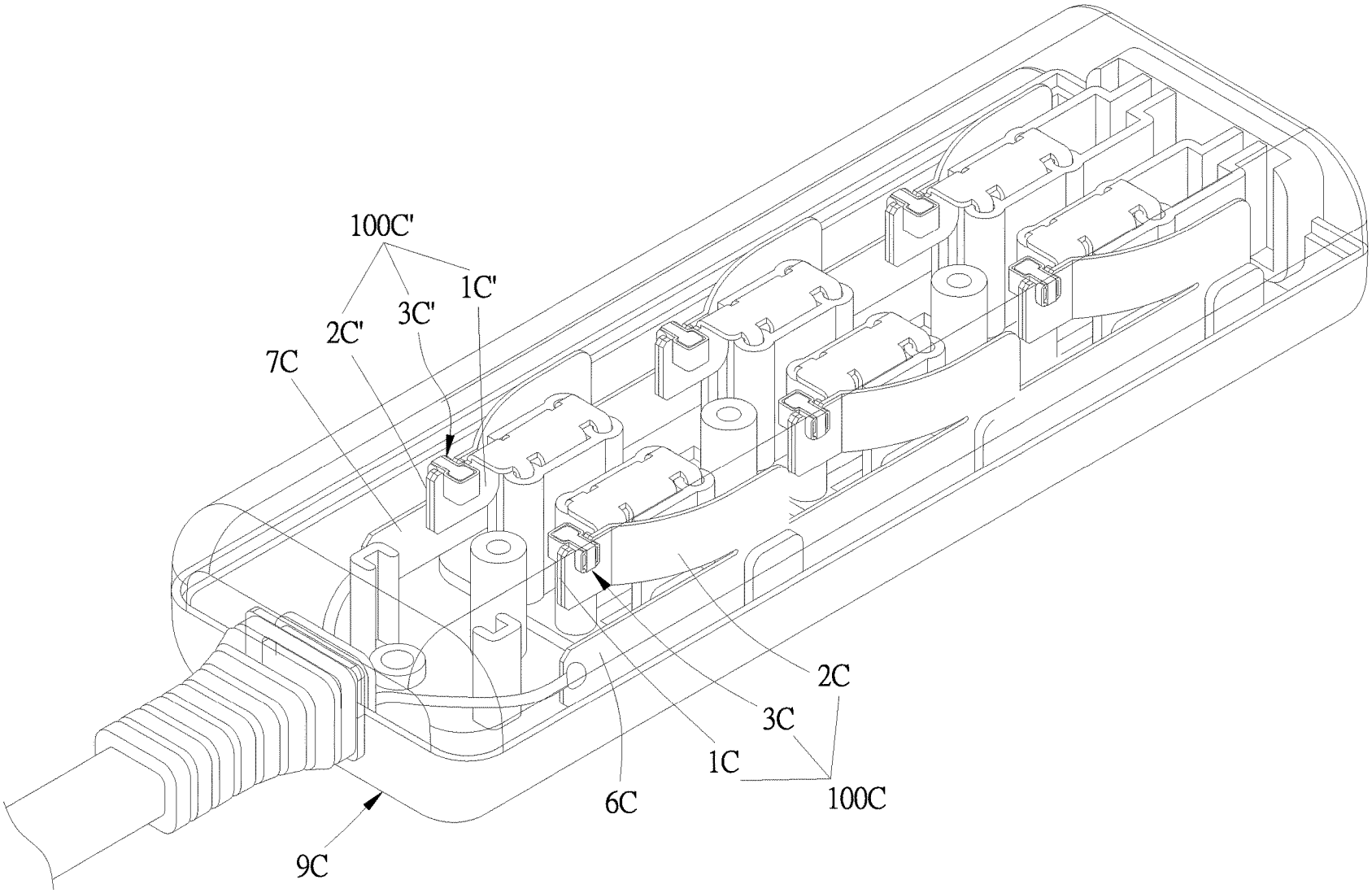
FIG. 9 is a schematic view 2 of the present invention used in a plug socket.

Referring to FIG. 8 and FIG. 9, which show a fourth embodiment of the present invention, which uses conducting strip overheating power off structures as overheating protection in a plug socket. The plug socket in the present embodiment comprises: a plurality of live wire slots (4C), a plurality of neutral wire slots (5C), a plurality of conducting strip overheating power off structures (1000), (100C'), a live wire (6C), a neutral wire (7C), and a body case (9C). The body case (9C) holds the aforementioned live wire slots (4C), the neutral wire slots (8C), the live wire (6C), the neutral wire (7C), and the conducting strip overheating power off structures (1000), (1000'). The body case (9C) is configured with a plurality of live wire sockets (91C) and a plurality of neutral wire sockets (92C), wherein the position of each of the live wire sockets (91C) corresponds to the respective live wire slot (4C), and the position of each of the neutral wire sockets (92C) corresponds to the respective neutral wire slot (8C). The form of each of the aforementioned conducting strip overheating power off structures (1000), (1000') is practically the same as that above-described in the first embodiment, wherein a first conducting strip (1C) and a second conducting strip (2C) in each of the conducting strip overheating power off structures (1000) are respectively connected to the respective live wire slot (4C) and the live wire (6C), and in a normal state uses an overheating destructive member (3C) in each of the conducting strip overheating power off structures (1000) to force the first conducting strip (1C) and the second conducting strip (2C) to contact each other. A first conducting strip (1C') and a second conducting strip (2C') in each of the conducting strip overheating power off structures (1000') are respectively connected to the neutral wire pin (5C) and the neutral wire (7C), and in a normal state uses an overheating destructive member (3C') in each of the conducting strip overheating power off structures (1000') to force the first conducting strip (1C') and the second conducting strip (2C') to contact each other.

Accordingly, phenomena such as oxides or dust present between the metal pins and the plug socket, incomplete insertion of the metal pins, or distortion of the metal pins will cause the live wire slots (4C) or the neutral wire slots (8C) of the plug socket to produce relatively large amounts of heat energy. At which time the heat energy is transferred to the overheating destructive members (1000) or the other overheating destructive members (1000'), which are destructed forthwith, thereby forming a broken circuit between the live wire slots (4C) and the live wire (6C) or/and between the neutral wire slots (5C) and the neutral wire (7C), thus achieving the object of overheating power-off.

In summary, the above description of the embodiments provides a clear understanding of the operational procedure, application, and the effects achieved by the present invention. However, it is of course to be understood that the embodiments described herein are merely illustrative of the principles of the invention and that a wide variety of modifications thereto may be effected by persons skilled in the art without departing from the spirit and scope of the invention as set forth in the following claims.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A plug socket with conducting strip overheating power off structure, comprising:

a live wire slot;

a neutral wire slot;

a first conducting strip, which connects to the live wire slot, wherein the first conducting strip is provided with a first notch;

a second conducting strip is provided with an acting force at a distance from the first conducting strip, and is further provided with a second notch corresponding to the first notch, the first notch and the second notch together form an indentation having an indentation width when superimposed;

an overheating destructive member, comprising a first limiting strip, a second limiting strip, a connecting portion, and a supporting member;

the first limiting strip is provided with a first free end, which is configured with a first limiting portion, and the first limiting strip astrides the indentation; the second limiting strip is provided with a second free end, which is configured with a second limiting portion, and the second limiting strip astrides the indentation; in a normal state, the distance between the first limiting strip and the second limiting strip is defined as an initial clearance, which is less than or equal to the indentation width; in a normal state, the maximum distance between the first limiting portion and the second limiting portion is defined as a limiting clearance, which is greater than the indentation width; the connecting portion connects the first limiting strip to the second limiting strip, and the supporting member is disposed between the first limiting strip and the second limiting strip; in a normal state, the supporting member limits contraction between the first limiting strip and the second limiting strip; and a body case holds the live wire slot, the neutral wire slot, the first conducting strip, the second conducting strip, the first limiting strip, the second limiting strip, the connecting portion, and the supporting member; the body case is configured with a live wire socket and a neutral wire socket, wherein the position of the live wire socket corresponds to the live wire slot, and the position of the neutral wire socket correspond to the neutral wire slot;

in a normal state, the first limiting portion or/and the second limiting portion force the second conducting strip to contact the first conducting strip, destruction of the supporting member occurs when the temperature thereof reaches an overheating temperature that exceeds the operating temperature, at which time the acting force forces the first limiting strip and the second limiting strip to move closer together, whereupon the limiting clearance is less than or equal to the indentation width, which causes the second conducting strip to be at a distance from the first conducting strip.

2. The plug socket with conducting strip overheating power off structure according to claim 1, wherein the first limiting strip, the second limiting strip, and the connecting portion are formed as a single body.

3. The plug socket with conducting strip overheating power off structure according to claim 1, wherein the first limiting strip, the second limiting strip, and the connecting portion are structured from conductive material to form a single body.

4. The plug socket with conducting strip overheating power off structure according to claim 1, wherein the first limiting portion or/and the second limiting portion is/are cambered surface(s).

5. The plug socket with conducting strip overheating power off structure according to claim 1, wherein the first limiting strip, the second limiting strip, and the connecting portion together define a holding space, and the shape of the supporting member corresponds to the holding space.

6. The plug socket with conducting strip overheating power off structure according to claim 1, wherein the maximum clearance of the connecting portion in the direction of the initial clearance is defined as a positioning clearance, which is greater than the indentation width.

7. A plug head with conducting strip overheating power off structure, comprising:

a live wire pin, a neutral wire pin, a first conducting strip, which connects to the live wire pin, wherein the first conducting strip is provided with a first notch;

a second conducting strip is provided with an acting force at a distance from the first conducting strip, and is further provided with a second notch corresponding to the first notch, the first notch and the second notch together form an indentation having an indentation width when superimposed;

an overheating destructive member, comprising a first limiting strip, a second limiting strip, a connecting portion, and a supporting member;

the first limiting strip is provided with a first free end, which is configured with a first limiting portion, and the first limiting strip astrides the indentation; the second limiting strip is provided with a second free end, which is configured with a second limiting portion, and the second limiting strip astrides the indentation; in a normal state, the distance between the first limiting strip and the second limiting strip is defined as an initial clearance, which is less than or equal to the indentation width; in a normal state, the maximum distance between the first limiting portion and the second limiting portion is defined as a limiting clearance, which is greater than the indentation width; the connecting portion connects the first limiting strip to the second limiting strip, and the supporting member is disposed between the first limiting strip and the second limiting strip; in a normal state, the supporting member limits contraction between the first limiting strip and the second limiting strip; and a main body, which holds the live wire pin, the neutral wire pin, the first conducting strip, the second conducting strip, the first limiting strip, the second limiting strip, the connecting portion, and the supporting member, wherein both the live wire pin and the neutral wire pin protrude out from the main body;

in a normal state, the first limiting portion or/and the second limiting portion force the second conducting strip to contact the first conducting strip, destruction of the supporting member occurs when the temperature thereof reaches an overheating temperature that exceeds the operating temperature, at which time the acting force forces the first limiting strip and the second limiting strip to move closer together, whereupon the limiting clearance is less than or equal to the indentation width, which causes the second conducting strip to be at a distance from the first conducting strip.

8. The plug head with conducting strip overheating power off structure according to claim 7, wherein the first limiting strip, the second limiting strip, and the connecting portion are formed as a single.

9. The plug head with conducting strip overheating power off structure according to claim 7, wherein the first limiting portion or/and the second limiting portion is/are cambered surface(s).

10. The plug head with conducting strip overheating power off structure according to claim 7, wherein the first limiting strip, the second limiting strip, and the connecting portion together define a holding space, and the shape of the supporting member corresponds to the holding space.

11. The plug head with conducting strip overheating power off structure according to claim 7, wherein the maximum clearance of the connecting portion in the direction of the initial clearance is defined as a positioning clearance, which is greater than the indentation width.

12. A conducting strip overheating power-off method, comprising the following steps:

configuring a first conducting strip and a second conducting strip, wherein the second conducting strip is provided with an acting force at a distance from the first conducting strip, the direction of the acting force is defined as an X direction, and the extension direction of the first conducting strip is defined as a Y direction;

configuring an overheating destructive member, which has initial dimensions in the Y direction in a normal state; when the overheating destructive member is exposed to an overheating temperature exceeding the operating temperature, the dimensions thereof change in the Y direction and form overheating dimensions, at which time the overheating dimensions are unable to force the second conducting strip to contact the first conducting strip;

in a normal state, the initial dimensions of the overheating destructive member are used to force the second conducting strip to contact the first conducting strip in the X direction, thereby forming a live wire closed circuit or a neutral wire closed circuit that enables the operating temperature of the first conducting strip or/and the second conducting strip to be transferred to the overheating destructive member; when the overheating destructive member is exposed to an overheating temperature exceeding the operating temperature, the acting force forces the dimensions of the overheating destructive member to form overheating dimensions in the Y direction, thereby causing the second conducting strip to separate from the first conducting strip to break the live wire closed circuit or the neutral wire closed circuit.

13. The conducting strip overheating power-off method according to claim 12, wherein, in a normal state, the overheating destructive member uses the supporting member to maintain the initial dimensions, and applies the conditions of over temperature destructing the supporting member and the supporting member having the function to form overheating dimensions.

14. The conducting strip overheating power-off method according to claim 12, wherein after the second conducting strip is forced to separate from the first conducting strip, the first conducting strip supports the overheating destructive member, thereby preventing the overheating destructive member from falling off.

* * * * *